United States Patent [19]

Carnahan et al.

[11] Patent Number: 4,816,791

[45] Date of Patent: Mar. 28, 1989

[54] STRIPLINE TO STRIPLINE COAXIAL TRANSITION

[75] Inventors: Blake A. Carnahan, Cazenovia; Peter P. Ilacqua, Memphis, both of N.Y.

[73] Assignee: General Electric Company, Syracuse, N.Y.

[21] Appl. No.: 126,037

[22] Filed: Nov. 27, 1987

[51] Int. Cl.[4] ..... H01P 5/02

[52] U.S. Cl. ..... 333/33; 333/238; 333/260

[58] Field of Search ..... 333/33–35, 333/238, 246, 460; 361/414; 439/578, 582

[56] References Cited

U.S. PATENT DOCUMENTS

| | | | |
|---|---|---|---|
| 2,938,175 | 5/1960 | Sommers et al. | 333/246 X |
| 2,983,884 | 5/1961 | Rueger | 333/33 |
| 3,483,489 | 12/1969 | Dietrich | 333/33 X |
| 3,533,023 | 10/1970 | Friend et al. | 333/246 |
| 3,757,272 | 9/1973 | Laramee et al. | 333/238 X |
| 3,895,435 | 7/1975 | Turner et al. | 333/33 X |
| 4,494,083 | 1/1985 | Josetsson et al. | 333/246 X |

*Primary Examiner*—Paul Gensler

*Attorney, Agent, or Firm*—Richard V. Lang; Carl W. Baker; Fred Jacob

[57] ABSTRACT

The invention relates to a transition between stripline transmission lines that is efficient at microwave frequencies and readily fabricated, and which may be used to achieve cross-overs in stipline circuits.

The transition includes a coaxial section placed between pads at the ends of the stripline conductors. The coaxial section is formed by a resilient center conductor surrounded by an incomplete circle of pins connected to the ground planes and forming the outer conductor. The connections to the pads enter the ends of the coaxial section at the azimuth of the gap in the circle of pins. Good high frequency performance despite the discontinuity between the pads and coaxial center conductor is achieved by increasing the characteristic impedance of the coaxial section and that of the stripline near the transition relative to the characteristic impedance of the stripline remote from the transition.

7 Claims, 5 Drawing Sheets

STRIPLINE TO STRIPLINE COAXIAL TRANSITION

BACKGROUND OF THE INVENTION

1. Field of the Invention

The invention relates to a transition between stripline transmission lines that is efficient at microwave frequencies and readily fabricated.

2. Prior Art

In high frequency circuits stripline transmission lines are in common use. The advantage of such circuits is that they may be patterned by an automated photographic process that allows for efficient electrical design. Stripline provides not only efficient high frequency runs from point to point, but many important passive functions such as impedance transformation, delay, filtering, power division or combination, and directional coupling.

A major limitation of stripline occurs when it is desired to effect cross-overs. There are, of course many circuit applications in which cross-overs are required. In an example of practical interest, the cross-over issue is presented in monitoring a four element antenna circuit of a phased array radar system for amplitude and phase. Cost constraints dictate that four antenna drive circuits be placed in a common package with four dipole antennas, four independent signal paths including filters to the four dipole antennas and four monitoring or calibrating paths. The monitoring, which may originate from one point, must in principle, cross at least two of the four antenna signal paths, if each signal path is to be monitored. Cross-over in the antenna stripline circuit is achieved by use of two coaxial transitions from a singly branched monitoring circuit also in stripline, and placed on the main antenna circuit. The two branches of the monitoring circuit enter the stripline of the antenna circuit at two transitions disposed between pairs of antenna paths. The monitoring circuit is then branched a second time on the antenna circuit, and the four branches are then coupled to the four antenna signal paths without further ado.

The transitions at microwave frequencies represent a problem as well as a solution to the cross-over problem. The transition, taking into account the constraints of stripline manufacture, and the small thickness dimensions in which a transition may occur, ordinarily create objectionable mismatches, electrical discontinuities, and parasitic reactances at such transitions. The customary result of these factors is to make transitions less than optimum at microwave frequencies.

SUMMARY OF THE INVENTION

Accordingly, it is an object of the invention to provide an improved transition between adjacent stripline transmission lines.

It is another object of the invention to provide a transition between adjacent stripline transmission lines that is simple in design.

It is still another object of the invention to provide a transition between adjacent stripline transmission lines that is readily manufactured by means compatible with printed circuit materials and processes.

It is a further object of the invention to provide a transition between adjacent stripline transmission lines which is of high performance at microwave frequencies.

These and other objectives of the invention are achieved in a combination comprising a mechanically rigid chassis, a first and a second electronic circuit employing stripline transmission lines attached to the chassis, the ground planes of the two striplines being arranged adjacent one another and in electrical contact, and a novel coaxial transition between the striplines.

The coaxial transition comprises a first and a second continuation of the conductors of the two striplines terminating in a pair of pads. The pads are disposed in mutually facing positions centered upon a common axis perpendicular to the layers of the striplines, with the paths to the pads approaching the axis from a common azimuth.

The coaxial transition further comprises a cylindrical conductor forming the inner conductor of the coaxial section aligned along the axis and interconnecting the pads, and a sequence of thin conductors parallel to the axis, arranged in a cylindrical surface centered upon the axis forming the outer conductor. The sequence is interrupted at the appropriate azimuth to admit connections. The thin conductors extend through the four ground planes, and are connected to each ground plane to ground the coaxial shield.

In accordance with further facets of the invention, each conductor in the shield has a flange at the center for contact with one of the internal ground planes, the conductors being disposed in holes penetrating the two circuits, with the ends soldered to the external ground planes. For good mechanical contact, the inner cylindrical member is of a partly resilient construction compressed in the assembly to provide a good contact between pads.

The transition performs well at microwave frequencies, although the connections between pads and the inner coaxial conductor exhibit significant shunt capacity tending to reduce high frequency performance. Good high frequency performance is achieved by making the characteristic impedance of the coaxial transmission line greater than that of the stripline to introduce series inductance in the coaxial transition, and the stripline paths are narrowed near the connection to the inner coaxial conductor to reduce shunt capacity, increase the characteristic impedance and introduce additional series inductance, to further improve the high frequency performance.

In accordance with a second embodiment of the invention, the shield is made of a thin copper sheet in a printed pattern having an elongated central region with thin conductors extending from the two elongated sides. The shield is bent into an incomplete cylindrical configuration. Punched out tabs from the central region and the ends of the thin conductors make contact with the ground planes. A one piece construction of the coaxial shield facilitates assembly of the transition.

BRIEF DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

DESCRIPTION OF THE PREFERRED EMBODIMENT

Figure 1:
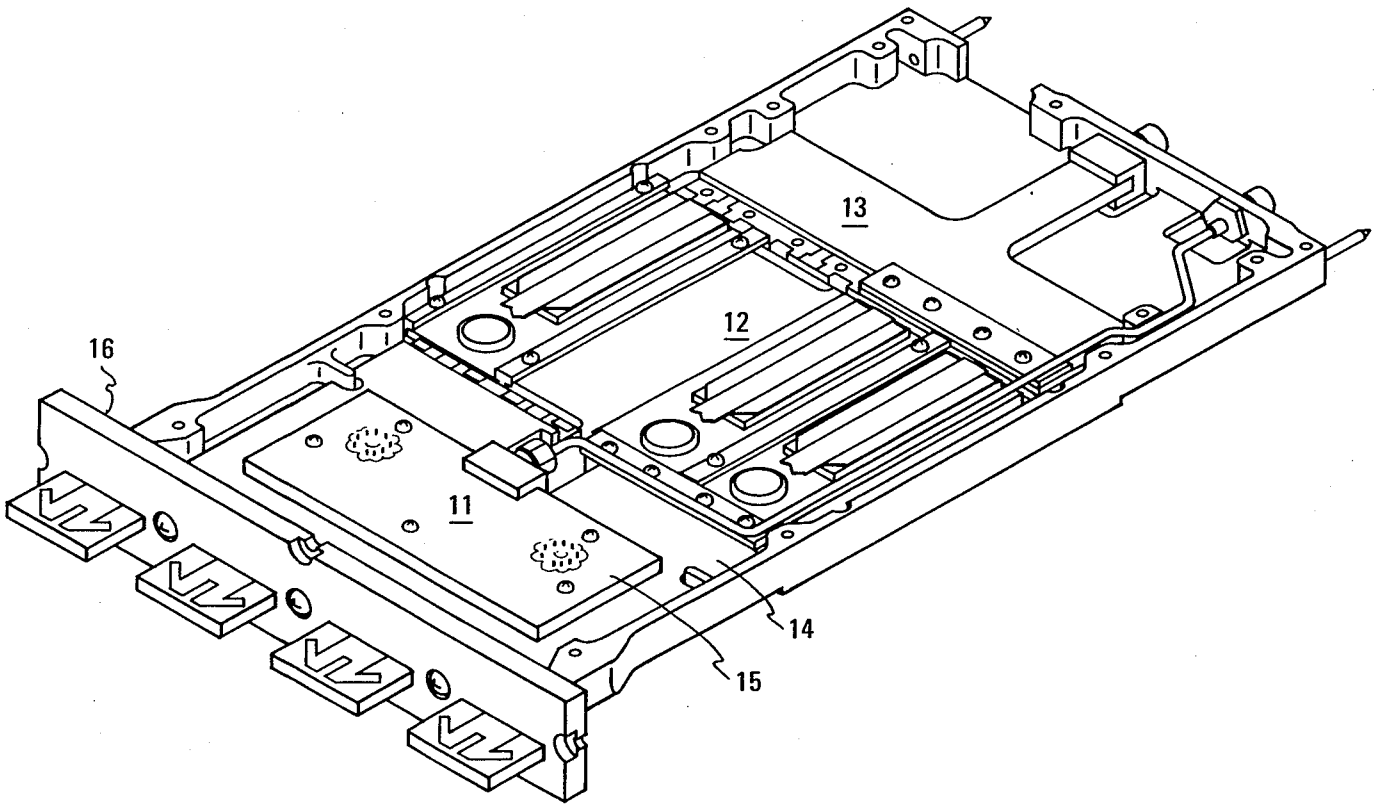
FIG. 1 is an illustration in perspective of a chassis intended for use in a phased array radar system containing an antenna monitoring and filtering circuit using stripline transmission paths, the arrangement requiring a stripline to stripline transition for the monitoring circuit.

FIG. 1 shows a chassis, from which the cover plate has been removed, containing the electronic circuits used to operate four elements of a phased array in a radar system operating from 5 to 6 GHz.

A high performance phased array radar system may be expected to have from 2,000 to 4,000 antenna elements at this frequency. Assuming that each chassis couples to four such antenna elements, one may expect from 500 to 1,000 such chassis in one system. The antenna elements are spaced from about one-half to two-thirds wavelengths apart, depending upon the scanning range. If a relatively low vertical scanning range is contemplated, the vertical spacing of the antenna elements, may be about two-thirds of a wavelength. If a relatively large horizontal scanning range is contemplated, the horizontal spacing between dipole elements will be about one-half wavelength. Dipole antenna elements, will be oriented in a vertical plane, when a larger horizontal scanning range is desired because more compact horizontal spacing is possible.

The demand that the cross-sectional area of the antenna operating circuitry not exceed the area dimensions of the array, forces the cross-sectional area of each chassis containing the antenna operating circuits to stay within the one-half to two-thirds wavelength dimensions allowed per antenna element. The benefit from this spacial restriction is that all r.f. paths may be of equal length and all r.f. components in these paths may be interchanged.

In the example at hand, the electronic circuits, which operate four antenna elements, fall within an overall cross-sectional dimension of 16 cm×2.7 cm, or 4 cm×2.7 cm per antenna element, which is compact enough to lie within the available spacing at 5 to 6 GHz.

The electronic circuits assembled within the chassis, which with the chassis may be called a "sub-assembly", includes the operating electronics necessarily in direct association with the antenna elements in a phased array radar system. The operating electronics includes an antenna distribution circuit 11, a phase shifter and T/R circuit 12, and a "beam-former" distribution circuit 13. In addition, the control circuits, together with local power supplies may be included in the sub-assembly to implement the steering commands to the phase shifter from a remote control computer.

The antenna distribution circuit or antenna-monitor-filter board 11 has three functions. In transmission, it couples the outputs of four high power amplifiers on an individual basis to each of four antenna elements which radiate the radar pulse. In reception, the echoes are received by the four antenna elements, and the antenna distribution network delivers the signal returns on an individual basis to each of four low noise amplifiers. Monitoring and calibration which occurs during transmission and when reception is inhibited, permits every module in the array to be examined. During transmission, the transmit power and transmit phase are checked by a signal derived from the monitoring path. When reception is inhibited, a test signal is introduced in a monitoring path which is used to test receive gain, receive phase. The logic functionality is tested in both states. The filtering, as will be explained, is designed to eliminate RF energy from external sources and to reduce the second and third harmonic content in the transmitter signal. The antenna distribution circuit 11 is passive, and is carried out using stripline transmission lines, which provide good shielding between circuits in the chassis, at low cost, and with the necessary compactness.

The beamformer distribution circuit 13 distributes a signal multiplexed from four separate receiving antennas to a single channel leading to the beamformer during reception, and similarly couples signals from the beamformer intended to operate upon four antenna elements. The beamformer distribution circuit has no active elements, and is preferrably carried out using stripline transmission lines.

The phase shifter and T/R circuit or "module" 12 is connected between the antenna distribution circuit and the beamformer distribution circuit which has separate parts for transmission and reception. During transmission, a beam steering command is carried out in the phase shifter for each individual module affecting the shape and direction of the transmitting beam. During reception, a beam steering command is also carried out in the phase shifter for each individual module, the phase shifter being bi-directional. Here again, the shape and direction of the receiving beam is affected by the command. The T/R circuit on the module, insures the proper routing of the signals through the module. During "monitoring", which allows one to test either in the transmit direction through the phase shifter or in the receive direction through the phase shifter, one may determine errors in either state, and thus provide a correction signal appropriate to either state.

Figure 2A:
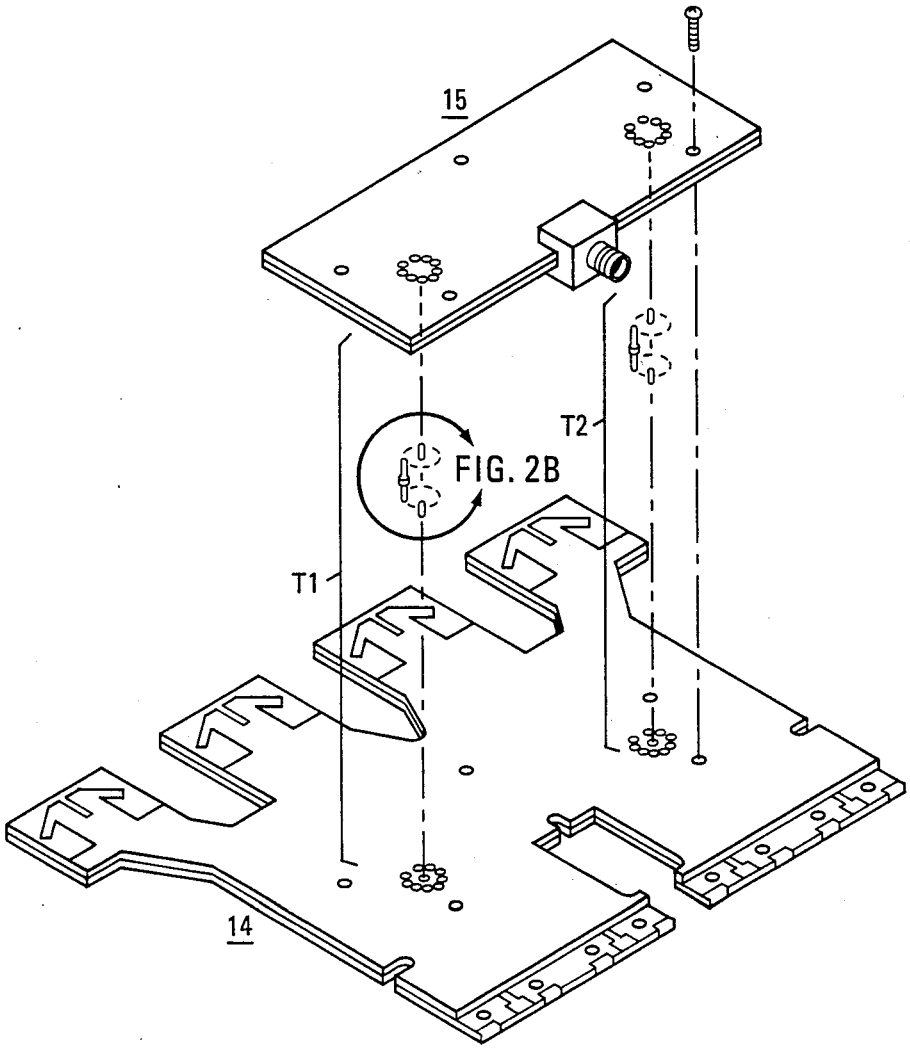
FIG. 2A is an exploded view in perspective of portions of the antenna monitoring and filtering circuit in which the stripline to stripline, coaxial transition finds application.
Figure 2B:
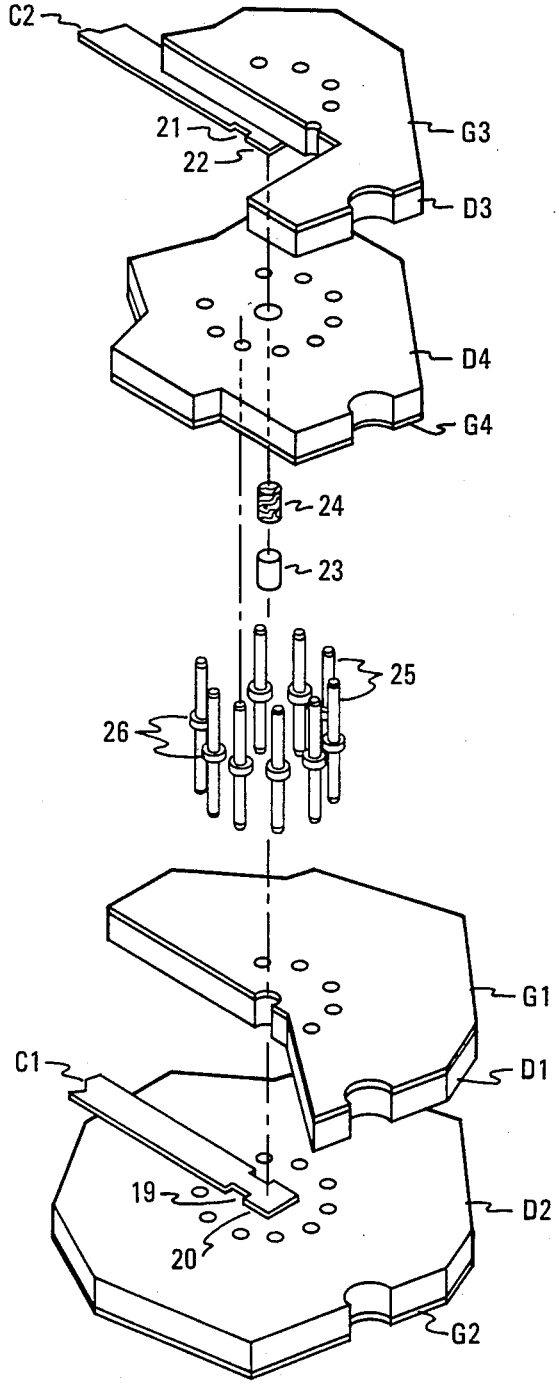
FIG. 2B is a more detailed exploded view showing the particulars of a stripline to stripline coaxial transition in accordance with a first embodiment of the invention.

The antenna monitor filter board 11 is best seen in the exploded view of FIG. 2A which illustrates its formation from two stripline circuits 14, 15 applied face-to-face and electrically interconnected by two stripline to stripline coaxial transitions, illustrated in more detail in FIG. 2B. The underlying stripline circuit 14, including a portion of the stripline to stripline transition associated with the under-circuit, is illustrated in FIG. 3, while the portion of the upper circuit including the portion of the stripline to stripline transition is illustrated in FIG. 4.

Figure 3:
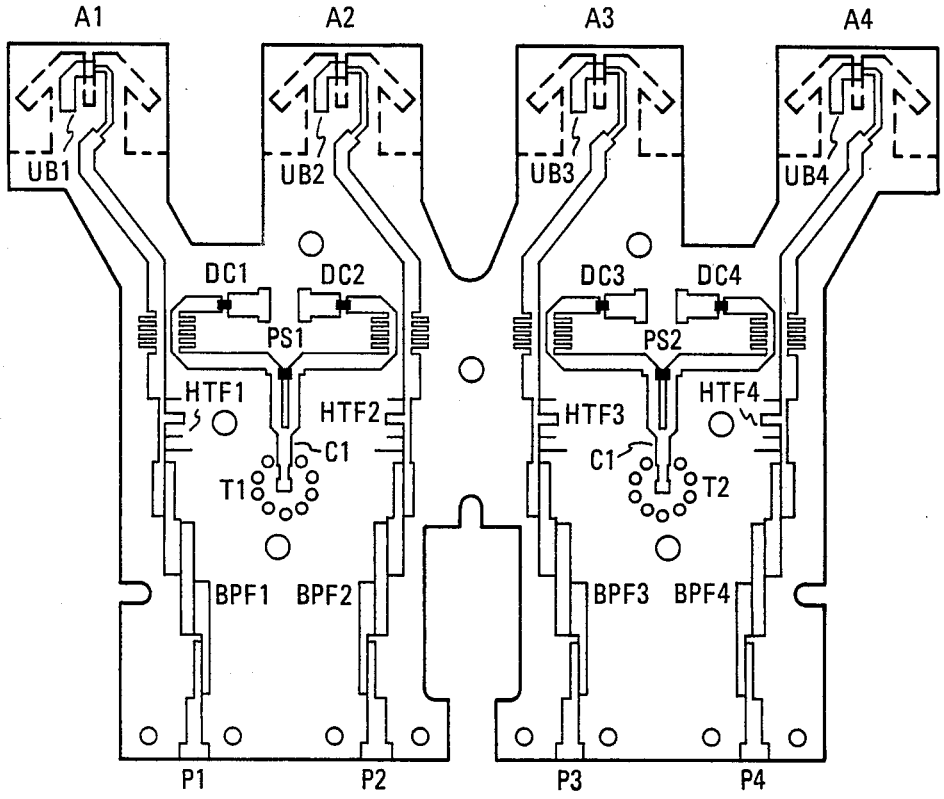
FIG. 3 is a plan view of the antenna filtering circuit, and radiating elements, including the stripline connections from that circuit to two coaxial transitions.

The antenna monitor filter 11, as best seen in FIG. 3, consists of four parallel stripline circuits, one set of ends of which occurs at the pads P1–P4 at the bottom of the figure and the other set of ends of which occurs at the antenna A1–A4. Each pad (e.g. P1) leads via stripline of nominally 50 ohms impedance, successively to a band-pass filter (BF1, etc), to a second and third harmonic trap (HTF1, etc), to a −20 DB directional coupler (DC1, etc) and via an unbalanced to balanced stripline antenna feed (UB1, etc) to a dipole antenna element (A1, etc).

The directional coupler (DC1, etc) is a −20 DB coupler active in the monitoring process. The directional coupler is designed to couple a small portion of the transmitted signal fed to the antenna to a first Wilkinson power splitter PS1, used in a combining mode during transmitter operation. The power splitter PS1 supplies the signal sampled from the first pad P1 and the signal sampled from the second pad P2 to the power splitter output at the short length of stripline C1 leading to the fist stripline to stripline transition T1. A second Wilkinson power splitter, also used in a combining mode, supplies the signal sampled from the third pad P3 and the signal sampled from the fourth pad P4 to the power splitter output of the short length of stripline C2 leading to the second stripline to stripline transition T2.

Figure 4:
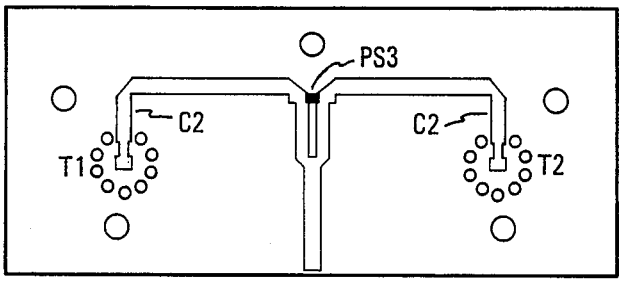
FIG. 4 is a plan view of the two-way stripline transmission distribution paths in the monitoring circuit including the stripline connections from that circuit to the same two coaxial transitions.

The monitor circuit is completed in the top board 15, the circuit of which is illustrated in FIG. 4. The top board includes a third Wilkinson power splitter PS3, to the output of which all four samples are supplied. The samples fed from the individual −20 DB couplers into the single monitoring path are fed to a single coaxial terminal, best seen in FIG. 1. A coaxial path is provided leading to a single monitoring connector at the back edge of the quadrapack. During transmission, if each module is successively turned on, one may analyze the exact state of each module including particularly the power level, the phase and the responsiveness of the module to computer control. During transmission, the antenna monitor filter circuit 11 filters the output of each module 12, eliminating the second and third harmonic and coupling the principal energy to the dipole antenna elements, less only a small amount of energy supplied by the −20 DB coupler DC1 to the monitoring circuit.

During reception, the antenna circuit carries a signal return back to the modules (12). The filter (BPF1–BPF4) is in the return path, where it serves to eliminate signals outside of the filter passband. The second role of the monitor reception is to determine the receiver gain, the phase response, and the responsiveness of the module to computer control. In this mode of operation, a predetermined signal is supplied to the coaxial terminal at the back of the chassis via the Wilkinson power splitter PS3 and then successively to the other Wilkinson power splitters PS1 and PS2. From thence the signal is selectively coupled through the −20 DB coupler via the filters HTF1, HTF2, etc and BPF1, BPF2, etc to the individual pads P1–P4 leading to the module. Thus, by turning on each module one at a time, one may determine the state of each of the modules during reception of the monitor signal.

The stripline to stripline coaxial transitions used to connect the two circuit boards 14 and 15 for antenna monitoring and filtering are shown in the exploded view of FIGS. 2A and 2B and in the plan view of FIGS. 3 and 4. The construction of the transitions involves a minimum increase in cross-section over that required for the two striplines alone, avoids leakage of the RF fields into surrounding space and has a low loss and low VSWR characteristic of a good transition.

As best seen in FIG. 1, the two boards 14 and 15 making up the antenna monitoring and filtering boards are fastened to the chassis with five mounting screws which pass through both boards and which secure them in place against the bottom of the chassis. As shown in FIGS. 2B and 2B, both boards are of similar construction being formed of a first and second dielectric layer with conductors forming the signal paths disposed on the lower dielectric layer only, between the dielectric layers. A first and second ground plane is provided on the outer surfaces of the dielectric layers of each circuit board.

The lower circuit board 14, as best seen in FIGS. 2A and 2B, employs stripline transmission to the input transition connected to the modules 12 and to the unbalanced to balanced antenna feeds at the dipole antennas. The lower board has an upper D1 and lower D2 dielectric layer between which the signal conductor C1 is supported. The lower ground plane G2 of the lower board 14 is unpatterned, until it enters the front frame 16, the front frame providing the ground plane for the antenna array at the frame 16, the lower ground plane is etched into a dipole antenna configuration similar to the upper ground plane G1 of the lower board which is also etched into a dipole antenna configuration. The upper ground plane G1 of the lower board is also unpatterned to the front frame 16 where a transition into the dipole elements occurs as illustrated.

The upper circuit board 15 also has a first D3 and a second D4 dielectric layer with a conductor C2 forming the signal path, disposed between the layers. The outer surfaces of the dielectric layers D3 and D4 support the ground planes G3 and G4 respectively.

The underlying ground plane G4 of the upper board 15 is removed in the circular areas surrounding the transitions T1 and T2. The removal is large enough to avoid individual spot-faced recesses, provided to accommodate the flanges 26 of the pins 25 used to form the coaxial shell in the transition. The area of ground plane removal is small enough as not to interfere with the continuity of the ground planes of the two striplines. When the two boards 14 and 15 are assembled with mounting screws pressing the upper board into engagement with the bottom of the chassis, the ground planes G1 and G4 are maintained in intimate contact. Accordingly, any spot facing in the vicinity of the pins forming the transition, prevents electrical discontinuity of the ground plane for either the upper or lower stripline and avoids RF leakage from the assembly. As a precaution, however, both boards may be provided with conductive edge shields, soldered to upper and lower ground planes, to bring the upper and lower ground planes into direct, shielding contact.

The coaxial transition in accordance with the first embodiment of the invention is illustrated in FIGS. 2A and 2B; FIGS. 3 and 4 illustrating the layout of the striplines as they enter the transitions. FIG. 2B is an exploded view of the transition T1.

The transition T1 consists of a continuation of a first conductor on the lower stripline 14 which has a narrow end section 19 terminating in a pad 20 and a second similar continuation of the second conductor C2 on the upper stripline 15 also comprising a narrowed section 21 terminating in a second pad 22. The pads are disposed in mutually facing positions centered on a common axis perpendicular to the planes of the dielectric layers. A concentric two-part cylindrical conductor 23, 24 aligned with the common axis interconnects the respective pads 20, 22. The transition further comprises a sequence of nine pin-shaped conductors 25 all oriented parallel to the common axis and all arranged in a cylindrical surface centered upon the common axis. The pin-shaped conductors 25 form a coaxial shield about the two-part cylindrical conductor 23-24 and facilitate coaxial transmission between the respective stripline circuits.

As illustrated, the signal conductors C1 and C2 enter the transition from common azimuthal positions in their respective planes. More particularly, the members Cl and C2 are oriented in a path perpendicular to the outer edge of the circuit board 14 (at the antennas) and extending inwardly toward the inner edge of the circuit board, toward the modules 12. The lower conductor Cl, accordingly, extends toward the center of the circle in which the pins 25 have been grouped. As illustrated, nine pin holes are provided at 36° intervals, evenly spaced around the two-part cylindrical conductor 23, 24 with a 72° gap, provided by the absence of a tenth pin to permit unobstructed entry of the strip conductor C1 into the center of the ring.

The center conductor of the coaxial transmission path is provided by the two-part cylindrical conductor 23, 24 connected between the pads 20 and 22. The layers D1, G1 and D4, G4 are perforated to provide a cylindrical recess of the diameter of the center conductor between the pads 20 and 22. The center conductor is of two-parts, consisting of a lower solid brass member 23 which is approximately of equal length to a second resilient conductor 24. The conductor 24 is a resiliently coiled conductive ball of gold, termed a "fuzz button". When the upper and lower circuit boards 14 and 15 are assembled together, the perforations in the upper and lower boards provide a cylindrical space which provides a slight axial compression when the members 23 and 24 are housed within it to provide positive electrical contact between pads 20 and 22.

The outer conductor or shield of the coaxial transmission path is provided by the nine brass pins 25. The pins are provided with rings 26 at approximately their mid-section, and two aligned sets of nine holes are provided in the lower and upper boards to house the pins in the finished assembly. During assembly, the rings 26 on each of the brass pins 25 are soldered to the intermediate ground plane Gl. The pins are made slightly longer than the thicknesses of the boards and emerge through the ground planes G2 and G3 to which they are soldered to complete the electrical contact. Thus, the pins provide segments of a surface which is directly connected to ground planes and which is capable of providing the grounded shield of a coaxial transmission path.

The electrical performance of the transition has been found to be excellent over a desired band of frequencies, the performance being evidenced by a low VSWR and low loss. The illustrated embodiment exhibits a VSWR of less than 1.09 throughout the 5 to 6 GHZ band, corresponding to a S11 loss of less than −26 DB and a S21 loss of approximately 0.5 DB. The measurements are substantially the same for either direction of transmission.

Good performance at these operating frequencies is achieved by selection of an adequate number of pins, nine being sufficient and seven evidencing inadequate field confinement, and by adoption of a design in which the striplines approach the coaxial transition from the same azimuth, which avoids electrical discontinuity at the middle of the coaxial region, and by adjustment of the dimensions of the transition, and particularly the dimensions of the stripline conductors in the transition until electrical measurements confirm optimization.

The stripline conductors C1 and C2, before they enter the transition, have a width of 0.100" and are supported between two 0.0625" thick Duroid layers having a dielectric constant of 2.2, each dielectric layer backed with a ground plane. The design produces a 50 ohm characteristic impedance.

The coaxial line portion of the transition has a characteristic impedance set by the selection of the diameters of the center conductor, the outer pins, the diameter of the ring of outer pins and the dielectric constant of the dielectric material filling the structure. In the coaxial portion of the transition, the diameter of the center conductor is 0.067", the diameter of the outer pins are 0.042", and the diameter of the circle on which the outer pins are placed is 0.340". The coaxial line portion has a characteristic impedance of about 63 ohms.

If the stripline and coaxial elements were directly assembled using 50 ohm sections, and without dimensional adjustment, a large reactive mismatch would occur at the point where the stripline pad joins the center conductor. The mismatch at certain frequencies of interest would provide excessive shunt capacitance. The adverse affect of this reactance is a shift in the center frequency of the pass band and a reduction in the bandwidth of the transition or more generally a reduction in "high frequency performance".

Choosing an increased impedance for the coaxial line section above that of the stripline (e.g. 63 ohms versus 50 ohms) is a first step in improving the high frequency performance of the transition. The electrical explanation is that a pi network with two shunt capacitances and a series inductance is produced, yielding improved high frequency performance. The available increase in performance by reducing the diameter of the central conductor in the necessarily short coaxial transition to increase the series inductance is normally limited by minimum practical diameters.

Additional improvement in high frequency performance is achieved by dimensional change in the stripline conductors C1 and C2. Where each conductor C1, C2 enters the ring of outer pins, its width is reduced to 0.070" for a distance of 0.075" and it terminates in a pad which is 0.080" wide and 0.090" long. The center of the pad coincides with the center of the cylindrical pin at the center of the coaxial line section.

The effect of these two dimensional changes in the stripline conductor is to raise the characteristic impedance to 71 ohms (approximately) at the necks (19, 21) and to drop it to 56 ohms at the pads (20, 22). The mismatch to the coaxial section is reduced so that the virtual shunt capacitance is reduced, and the two features (19, 20) and (21, 22) may each be regarded as introducing a series inductance in position adjacent to the pi network. The end result is further improved high frequency performance at 5.5 GHZ.

Good electrical performance at microwave frequencies is hard to achieve in a transition which by stripline constraints, requires an abrupt change in direction in the signal path from a path parallel to the planes of the lamina to a path perpendicular to the planes of the lamina. The change in direction must occur within the available stripline thicknesses, be compatible with stripline processing and be facilitated with simple unbent cylindrical inserts that will fit into bored spaces. The mechanical constraints thus create the electrical discontinuities which produce the high frequency performance limiting reactances at the joints between the stripline pads and the central conductor of the coaxial transmission line. The present design satisfies the electrical requirements within these mechanical constraints.

The design succeeds, and does so in a reproducable manner. The design is one which is easily "trimmed" to provide optimized performance over a designated band of frequencies in the microwave spectrum. The trimming involves the strip conductor paths which are patterned by a photographic process. Accordingly, once trimming of a practical circuit has taken place, the critical features are readily perpetuated in a new pattern, which may be used for subsequent reproduction.

Figure 5:
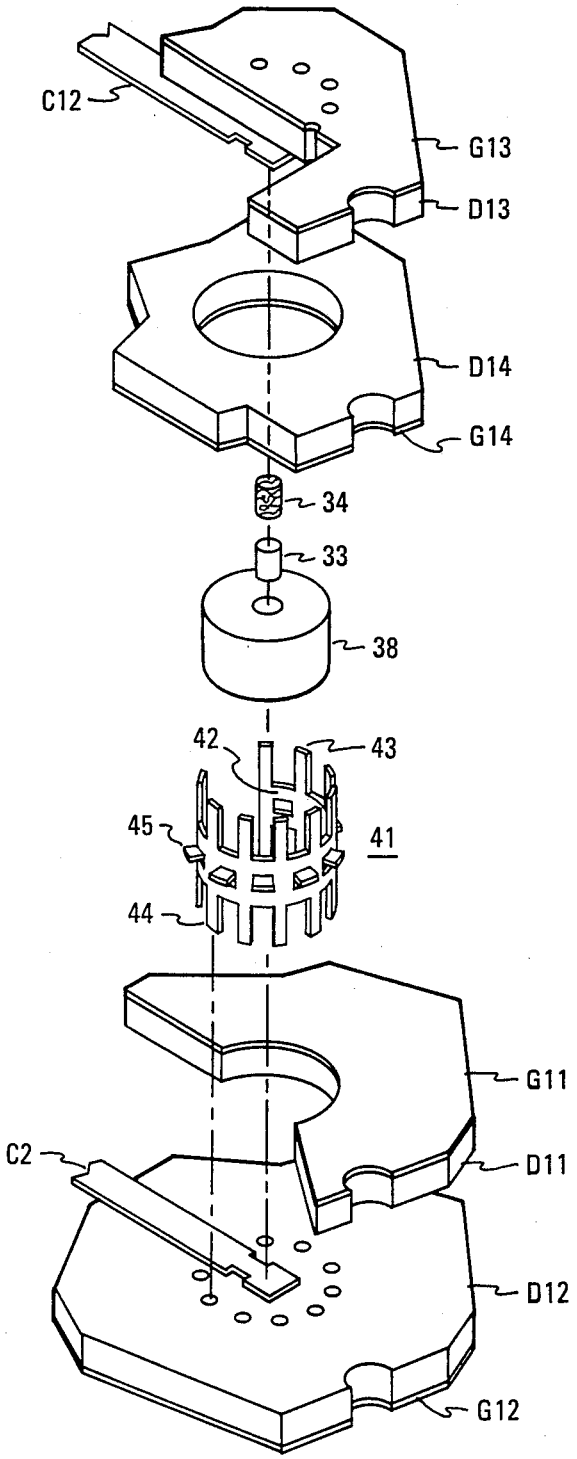
FIG. 5 is an exploded view of a stripline to stripline coaxial transition in accordance with a second embodiment of the invention.

A second embodiment of a stripline to stripline transition, which is more easily assembled and of lower cost, is illustrated in FIG. 5. The electrical design issues are essentially as before. For convenience, the members illustrated in FIG. 5 and repeated in FIGS. 2A and 2B, bear reference numerals, raised by ten over the original reference numerals.

Greater convenience in assembly is provided by a one piece shield, formed by photographically patterning a sheet of thin (0.003" to 0.005") copper. The sheet is patterned to consist of an elongated central section (42) with a first (43) and a second (44) sequence of thin conductors extending out from the long sides of the central section. In addition, the central section 42 is provided with a series of short tabs 45 achieved by punching out material from the central section. The tabs are aligned in a row parallel to the long sides of the central section, and they extend in a direction perpendicular to the plane of the sheet.

The copper sheet is then bent into a cylindrical surface with the tabs 45 extending outwardly. The first 43 and second 44 sequence of thin conductors extend in mutually opposite directions from the long sides of the central section. In bending, the sheet forms an incomplete cylinder, with an interruption or opening of approximately 72° through which the connections to the stripline conductors are admitted.

The cylindrical sheet is installed in a cylindrical recess provided in the dielectric layers D14 and D11. The upper and lower edges of the central cylindrical surface thus extend through the dielectric layers D14 and Dll and come into contact with the dielectric layers D13 and D12. The recess has an inner diameter equal to the outer diameter of the member 41 to provide external support. A dielectric disc 38 having an outer diameter equal to the inner diameter of the member 41 provides internal support. The disc 38 is further provided with a central aperture designed to accept and support the cylindrical conductor made up of the elements 33 and 34.

Grounding of the member 41 is achieved by the thin conductors and tabs. One sequence (43) of thin conductors extends through holes provided in the dielectric layer D13 and in the ground plane G13. Similarly, the other sequence (44) of thin conductors extends through holes provided in the dielectric layer D12 and the ground plane G12. The portions of the thin conductors extending beyond the ground planes are then peened over and soldered. The tabs 45 make electrical contact with either the ground plane G11 or G14 or both and rely on a resilient compression fit.

The dielectric material herein employed may be one of several available microwave laminates. They are characterized by a low dielectric constant (e.g. 2.2), good tensile, and compressive properties, and a low coefficient of thermal expansion in a plane parallel to the lamina.

What is claimed is:

1. In combination:

(A) a first electronic circuit employing a first stripline transmission line, comprising a first dielectric layer having a first ground plane, a second dielectric layer having a second ground plane, said second dielectric layer being disposed in parallel proximity to said first dielectric layer with a first conductor of finite width supported between said first and second dielectric layers, (B) a second electronic circuit employing a second stripline transmission line, comprising a third dielectric layer having a third ground plane, a fourth dielectric layer having a fourth ground plane, said fourth dielectric layer being disposed in parallel proximity to said third dielectric layer with a second conductor of finite width supported between said third and fourth dielectric layers, said electronic circuits being assembled together with said second and third ground planes adjacent and in electrical contact;

(C) a coaxial transition between said striplines comprising (1) a first continuation of said first conductor terminating in a first pad, (2) a second continuation of said second conductor terminating in a second pad, said pads being centered upon a common axis perpendicular to the planes of said dielectric layers with said continuations approaching said axis from a common azimuth, (3) a third, cylindrical conductor aligned on said axis, and interconnecting said pads, and (4) a sequence of thin conductors parallel to said axis, arranged in a cylindrical surface centered upon said axis, the sequence being interrupted to admit connections to said pads, the thin conductors of said sequence extending through said first, second, third and fourth ground planes, and being connected to each to form a grounded virtual coaxial shield about said third conductor for coaxial transmission between said electronic circuits, said coaxial transition exhibiting a characteristic impedance greater than that of said stripline transmission lines to introduce a series inductance in the coaxial transition, and said first and second continuations being narrowed within said coaxial shield to reduce shunt capacitance, increase the characteristic impedance and introduce additional series inductance to reduce the effect of significant shunt capacitance between said pads and said third conductor to improve the performance of said transition.

2. In combination:

(A) a first electronic circuit employing a first stripline transmission line, comprising a first dielectric layer having a first ground plane, a second dielectric layer having a second ground plane, said second dielectric layer being disposed in parallel proximity to said first dielectric layer with a first conductor of finite width supported between said first and second dielectric layers, (B) a second electronic circuit employing a second stripline transmission line, comprising a third dielectric layer having a third ground plane, a fourth dielectric layer having a fourth ground plane, said fourth dielectric layer being disposed in parallel proximity to said third dielectric layer with a second conductor of finite width supported between said third and fourth dielectric layers, said electronic circuits being assembled together with said second and third ground planes adjacent and in electrical contact, (C) a coaxial transition between said striplines comprising (1) a first continuation of said first conductor terminating in a first pad, (2) a second continuation of said second conductor terminating in a second pad, said pads being centered upon a common axis perpendicular to the planes of said dielectric layers with said continuations approaching said axis from a common azimuth, (3) a third, cylindrical conductor aligned on said axis, and interconnecting said pads, and (4) a first and second sequence of thin conductors parallel to said axis, extending axially from a central cylindrical surface centered upon said axis and formed from a common metallic sheet, said sequences and central surface being opened at said azimuth to admit said continuations terminating in said pads, the upper and lower edges of said central cylindrical surface penetrating the second and third dielectric layers and engaging said first and fourth dielectric layers, with the first sequence of thin conductors extending through said first dielectric layer and extending through and bonded in electrical and mechanical contact with said first ground plane, and the second sequence of narrow conductors extending through said fourth dielectric layer and extending through and bonded in electrical and mechanical contact with said fourth ground plane to form a grounded coaxial shield about said third conductor for coaxial transmission between said electronic circuits.

3. The combination set forth in claim 2, wherein, said coaxial transition has a characteristic impedance greater than that of said stripline transmission lines to introduce series inductance in the coaxial transition, and said first and second continuations are narrowed within said coaxial shield to reduce shunt capacitance, increase the characteristic impedance and introduce additional series inductance to reduce the effect of significant shunt capacitance between said pads and said third conductor to improve the performance of said transition.

4. The combination set forth in claim 2 wherein the bonding of said first and second sequences of thin conductors to said first and fourth ground planes, respectively are achieved by peening over and soldering.

5. The combination set forth in claim 4 wherein radially extending tabs are punched from said metallic sheet positioned to make contact with at least one of said second and third ground planes.

6. The combination set forth in claim 5 wherein a perforated circular dielectric disk is installed within said coaxial transition to support said third cylindrical conductor and said coaxial shield, said disk having a thickness equal to the sum of the thicknesses of said second and third dielectric layers, a central perforation having a diameter equal to the diameter of said third cylindrical conductor, and an outer diameter equal to the inner diameter of said virtual coaxial shield.

7. The combination set forth in claim 6 wherein said third cylindrical conductor is at least in part a resilient conductor, installed under compression to provide electrical contact between said third conductor and said first and second pads.

* * * * *